US008472820B2

(12) United States Patent
Matsumoto

(10) Patent No.: US 8,472,820 B2
(45) Date of Patent: Jun. 25, 2013

(54) IMAGE FORMING APPARATUS

(75) Inventor: Hiroshi Matsumoto, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 195 days.

(21) Appl. No.: 12/945,686

(22) Filed: Nov. 12, 2010

(65) Prior Publication Data

US 2011/0129243 A1 Jun. 2, 2011

(30) Foreign Application Priority Data

Dec. 1, 2009 (JP) ..... 2009-273307

(51) Int. Cl.
*G03G 15/00* (2006.01)

(52) U.S. Cl.
USPC ..... 399/45

(58) Field of Classification Search
USPC ..... 399/45, 149, 150, 252, 259, 323, 399/325, 346
See application file for complete search history.

(56) References Cited

U.S. PATENT DOCUMENTS

2005/0244202 A1* 11/2005 Aslam et al. ..... 399/341
2007/0071474 A1* 3/2007 Watanabe et al. ..... 399/67
2008/0050132 A1* 2/2008 Boness et al. ..... 399/40
2008/0152391 A1* 6/2008 Bae et al. ..... 399/231
2008/0160435 A1* 7/2008 Lim et al. ..... 430/48
2008/0266371 A1* 10/2008 Ma et al. ..... 347/96
2008/0317516 A1* 12/2008 Hyakutake ..... 399/297
2009/0034998 A1* 2/2009 Omata ..... 399/45
2009/0238616 A1* 9/2009 Ciaschi ..... 399/341

FOREIGN PATENT DOCUMENTS

JP 2002-207334 7/2002
JP 2002-341619 11/2002

* cited by examiner

*Primary Examiner* — David Gray
*Assistant Examiner* — Thomas Giampaolo, II
(74) *Attorney, Agent, or Firm* — Squire Sanders (US) LLP

(57) ABSTRACT

An image forming apparatus, comprises an image forming section, a transfer section to transfer the toner image onto a recording material; and a fixing device to fix the toner image onto the recording material; wherein the image forming section includes a plurality of color image forming sections and a transparent image forming section, and the plurality of color image forming sections and the transparent image forming section are arranged such that the transparent image is transferred so as to form a transparent image layer on an outer surface of the color image on the recording material at a fixing time by the fixing device, and wherein an amount of wax contained in the transparent toner is larger than an amount of wax contained in each color toner of the plurality of color toners and smaller than an amount of base resin contained in the transparent toner.

12 Claims, 4 Drawing Sheets

IMAGE FORMING APPARATUS

This application is based on Japanese Patent Application No. 2009-273307 filed on Dec. 1, 2009, in Japanese Patent Office, the entire content of which is hereby incorporated by reference.

BACKGROUND OF THE INVENTION

The present invention relates to an image forming apparatus that forms a transparent toner layer on the outermost surface of a recording material and improves a separating ability of a recording material being passing through a fixing device.

In electro-photographic type image forming apparatus, such as copying machines, printers, facsimile machines and composite machines provided with their various functions, a latent image corresponding to a document is formed on a photoreceptor and visualized by being provided with toner, the visualized toner image is transferred onto a recording paper sheet, thereafter, the toner image transferred onto the recording paper sheet is fixed, and then the fixed recording paper sheet is discharged.

As a fixing device to fix a toner image in such a way, there is a heat roller fixing type fixing device which heats and presses a recording paper sheet, on which a toner image is transferred, while pinching and conveying the recording paper sheet at a nip section formed by a fixing roller incorporating a halogen heater and the like therein and a pressing roller pressing the fixing roller. Since such a fixing device has a simple structure, it has been widely utilized.

Further, there is a belt fixing type fixing device which comprises an endless fixing belt wound around a heating roller incorporating a halogen heater and the like therein and a fixing roller and a pressing roller pressing the fixing roller across the fixing belt, and heats and presses a recording paper sheet, on which a toner image is transferred, while pinching and conveying the recording paper sheet at a nip section formed by the fixing belt and the pressing roller. In such a fixing device, since the heat capacity of the fixing belt is small, there are advantages that a warming-up time can be shortened and energy can be saved.

In the fixing device, when recording paper sheet passes through the nip section, toner of a toner image formed on the recording paper sheet is heated. Accordingly, since the heated toner is provided with adhesive force, there is fear that the recording paper sheet having passed through the nip section adheres to a surface of the fixing roller or the fixing belt, winds around them, and causes jamming. Especially, in the case where a thin sheet paper with a small basic weight or a print-use coated sheet paper is employed, the separating ability becomes low more.

On the other hand, if the diameter of a fixing roller is made large such that a nip width becomes a sufficient length corresponding to the speed-up in an image forming apparatus, since a curvature factor of a roller at the exit of a fixing nip becomes small due to it, the separating ability becomes low.

Further, in the case where a plurality of color toners is superimposed in order to form a color image, since amount of toners increases, the adhesive force of the superimposed toners increases.

Therefore, a separating section is employed in order to separate a recording paper sheet mechanically from a fixing roller and the like. As such a separating section, at a sheet discharging side of a nip section, a separating claw coated with a fluorine resin having a good mold releasing ability is provided such that a tip of the separating claw is brought in contact with an outer surface of a fixing roller or a fixing belt so as to separate a recording paper sheet from the fixing roller or the fixing belt.

As another aspect, in order to obtain an image in which an image surface is smooth all over the whole surface of the image and which has high glossiness without depending on an image density, well known is a gloss providing apparatus to transfer and fix a toner image composed of a transparent toner so as to provide gloss (refer to Patent Document 1: Japanese Unexamined Patent Publication No. 2002-341619).

Further, in order to make a photographic image area of a document to a gloss surface and a character image area to a gloss surface with semi-gloss, well known is an image forming apparatus which has a unit to develop with a transparent toner of semi-gloss and a transparent toner of gloss at an uppermost stream side in a conveying direction and develops a photographic image area with a glossy transparent toner and a whole area of images with a semi-glossy transparent toner so as to superimpose the semi-glossy transparent toner on a color toner layer (refer to Patent Document 2: Japanese Unexamined Patent Publication No. 2002-207334).

In the case where a separating claw is provided as described above, there are problems that since the tip of the separating claw is brought in contact with a surface of a fixing roller and the like, scratches are caused on a surface layer formed by fluorine resin so as to cover the surface of the fixing roller and the like, and such scratches are transferred onto an image. In this case, since a color image is required to be a gloss image, scratches tend to be exhibited appreciably on the color image.

For this reason, it is desirable to separate a recording paper sheet without employing a separating claw.

SUMMARY OF THE INVENTION

The present invention has been achieved in view of the above problems, and an object of the present invention is to propose an image forming apparatus adapted to increase a separating ability of a recording paper sheet being passing through a fixing device by forming a layer on an outermost surface of a recording paper sheet with transparent toner containing a larger amount of wax than ordinary color toner.

Although Patent Documents 1 and 2 disclose to employ transparent toner, the employment of transparent toner is intended to obtain an image with gloss and is not intended to increase a separating ability. Further, Patent Documents 1 and 2 do not teach not suggest to employ transparent toner in order to increase a separating ability.

The above object can be attained by an image forming apparatus that reflects one aspect of the present invention.

Namely, the image forming apparatus, comprises:

an image forming section having a photoreceptor, a charging section to charge a surface of the photoreceptor, an exposing section to irradiate the photoreceptor with light so as to form an electrostatic latent image, and a developing section to develop the electrostatic latent image formed on the photoreceptor so as to form a toner image;

a transfer section to transfer the toner image onto a recording material; and a fixing device to fix the toner image onto the recording material;

wherein the image forming section includes a plurality of color image forming sections to form a color image with a plurality of color toners each containing wax and a transparent image forming section to form a transparent image with a transparent toner containing wax, and the plurality of color image forming sections and the transparent image forming section are arranged such that the transparent image is transferred so as to form a transparent image layer on an outer surface of the color image on the recording material at a fixing time by the fixing device, and wherein an amount of wax contained in the transparent toner is larger than an amount of wax contained in each color toner of the plurality of color toners and smaller than an amount of base resin contained in the transparent toner.

DETAILED DESCRIPTION OF THE PREFERRED EMBODIMENT

Hereafter, an embodiment of an image forming apparatus relating to the present invention will be explained with reference to the structural drawing showing in FIG. 1. However, the present invention is not limited to the embodiment.

Figure 1:
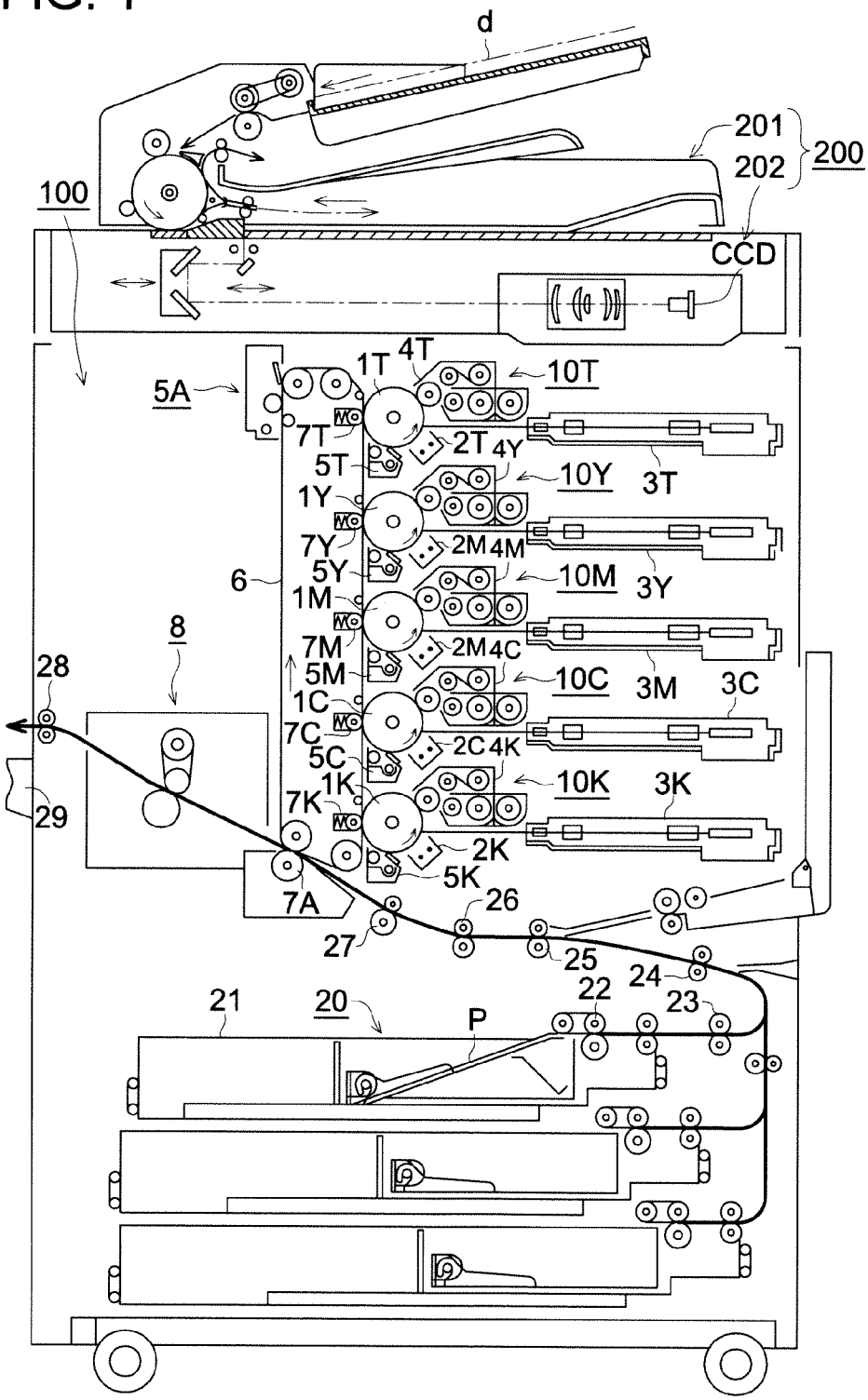
FIG. 1 is a structural drawing of an image forming apparatus.

In order to increase a separating ability of a recording paper sheet (recording material) being passing through a fixing device, the image forming apparatus shown in FIG. 1 is adapted to make transparent toner adhere onto an outer surface of a recording paper sheet, wherein the transparent toner is made in such a way that coloring agent is removed from ordinary color toner to form a color image and was is added into the resultant toner with an amount larger than that in the ordinary color toner.

This image forming apparatus 100 is called a tandem type color image forming apparatus and is constituted with a plurality of image forming sections 10T, 10Y, 10M, 10C, 10K, a belt-shaped intermediated transfer member 6, a sheet conveying section 20, and a fixing device mentioned later in detail.

On the upper section of the image forming apparatus 100, an image reading device 200 constituted with an automatic document feeding unit 201 and a document image scanning exposing unit 202 is mounted.

Documents placed on a document stand of the automatic document feeding unit 201 are conveyed by a conveying section and images on one side or both side of documents are subjected to scanning exposure by an optical system of the document image scanning exposing unit 202 and are read by a line image sensor CCD.

Analog signals photo-electrically converted by the line image sensor CCD are subjected to analog processing, A/D conversion, shading correction, image compressing processing and the like, thereafter the resultant signals are inputted into exposing sections 3T, 3Y, 3M, 3C, 3K.

An image forming section 10T to form a transparent image (T) includes a charging section 2T, an exposing section 3T, a developing device 4T and a cleaning device 5T that are arranged around a periphery of a photoreceptor drum 1T as an image carrying member. An image forming section 10Y to form an yellow image (Y) includes a charging section 2Y, an exposing section 3Y, a developing device 4Y and a cleaning device 5Y which are arranged around a periphery of a photoreceptor drum 1Y as an image carrying member. An image forming section 10M to form a magenta image (M) includes a charging section 2M, an exposing section 3M, a developing device 4M and a cleaning device 5M which are arranged around a periphery of a photoreceptor drum 1M as an image carrying member. An image forming section 10C to form a cyan image (C) includes a charging section 2C, an exposing section 3C, a developing device 4C and a cleaning device 5C which are arranged around a periphery of a photoreceptor drum 1C as an image carrying member. An image forming section 10K to form an yellow image (K) includes a charging section 2K, an exposing section 3K, a developing device 4K and a cleaning device 5K which are arranged around a periphery of a photoreceptor drum 1K as an image carrying member. The charging section 2T and the exposing section 3T, the charging section 2Y and the exposing section 3Y, the charging section 2M and the exposing section 3M, the charging section 2C and the exposing section 3C, and the charging section 2K and the exposing section 3K constitute a latent image forming section respectively.

The developing devices 4T, 4Y, 4M, 4C, and 4K include respective toners of a transparent toner, or a color toner of a yellow toner, a magenta toner, a cyan toner or a black toner. The glass transition temperature of each toner is about 60° C., and their melting point is about 110° C.

The transparent toner is composed of resin which does not contain a coloring agent, for example, composed of a styrene-acrylic type copolymer resin obtained by the copolymerization of a styrene type monomer, an acrylic ester monomer, and a methacrylic acid ester monomer. Moreover, thermoplastic resins such as polyester resin and thermo-hardening resin may be also used for the transparent toner. An amount of wax added in the transparent toner used in the present invention is larger than an amount of wax added in each of the plurality of color toners and smaller than an amount of base resin contained in the transparent toner. If an added amount of wax is larger than the amount of base resin contained in a transparent toner, a sea island structure composed of wax component and resin component is reversed and the wax component is configured such that a plenty of wax is located on the surface of the transparent toner. With this, it is presumed that carrier or a photoreceptor may be polluted.

In this specification, when a transparent toner containing a large amount of wax is distinguished from the usual transparent toner, such a transparent toner is called a wax-rich transparent toner. Such a wax-rich transparent toner contains wax in an amount of 10 to 40% by weight, preferably an amount of 13 to 35% by weight, and more preferably an amount of 15 to 30% by weight.

The image forming section 10Y, the image forming section 10M, the image forming section 10C, and the image forming section 10K, which form a color image with a color toner respectively, are called a color image forming section, and the image forming section 10T, which forms a transparent image with a transparent toner, is called a transparent image forming section.

The intermediate transfer member 6 is wound around a plurality of rollers, and is supported to be rotatable.

The images of respective colors formed by the image forming sections 10T, 10Y, 10M, 10C, and 10K are transferred sequentially (primary transfer) by primarily transferring sections 7T, 7Y, 7M, 7C, and 7K on the rotating intermediate transfer member 6, whereby a synthesized color image is formed on a transparent image.

A recording paper sheet P (recording material) accommodated in a paper sheet cassette 21 of a sheet conveying section 20 is fed out by a sheet feeding section 22, and is conveyed to a transfer roller 7A via feed rollers 23, 24, 25, and 26 and a registration roller 27, and then a color image and a transparent image on the intermediate transfer member 6 are transferred (secondary transfer) on the recording paper sheet P. At this time, the transparent image formed by the transparent toner is layered on an outer surface of the recording paper sheet P than the color image formed by color toners composed of yellow, magenta, cyan, and black. Further, the transparent image may be also transferred so as to adhere on a white background portion where no image is formed.

The recording paper sheet P on which a color image has been transferred is pinched by the fixing device 8 so as to be added with heat and pressure, whereby toner images on the recording paper sheet P are fixed, and then the recording paper sheet P is discharged by a discharging roller 28 and placed on a sheet delivery tray 29 at the outside of the apparatus.

On the other hand, a color image is transferred from the intermediate transfer member 6 onto a recording paper sheet P by the transfer roller 7A, then the recording paper sheet P is separated from the intermediate transfer member 6 by its curvature, and thereafter, residual toner remaining on the intermediate transfer member 6 after the transferring is removed by a cleaning device 5A.

Herein, it is desirable that the image forming section 10T, the image forming section 10Y, the image forming section 10M, the image forming section 10C, and the image forming section 10K are arranged at a location distant from the fixing device 8 such that respective toners are not influenced by heat from the fixing device 8.

Figure 2:
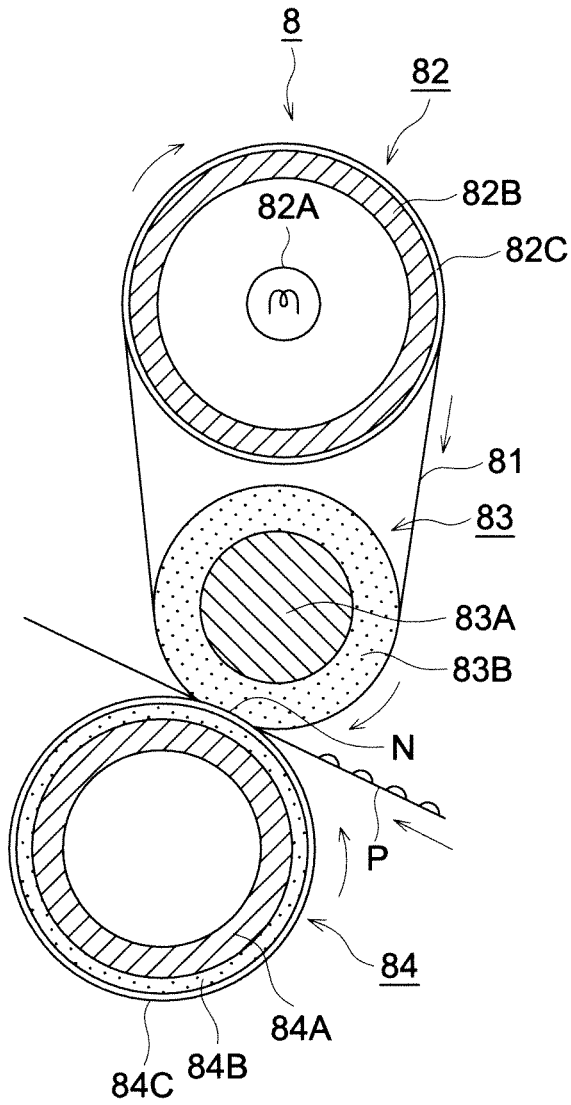
FIG. 2 is a cross sectional view of a fixing device.

Next, the fixing device 8 will be explained with reference to the cross sectional view of FIG. 2.

The fixing belt 81 is formed in an endless form and is constituted such that, for example, a peripheral surface of a substrate made of conductive PI (polyimide) with a thickness of 70 μm is covered with an elastic layer made of a heat-resistant silicon rubber (hardness JIS-A30) with a thickness of 220 μm, and is further covered with a tube made of PFA (perfluoroalkoxy) being a heat resistant resin with a thickness of 30 μm. Here, for example, an inside diameter is 80 mm.

The heating roller 82 incorporates a halogen lamp 82A to heat the fixing belt 81 and is constituted such that, for example, an outer periphery of a cylindrical metallic core 82B made of aluminium with a thickness of 3 mm is covered with a resin layer coated with PFA with a thickness of 30 μm. Here, for example, an outer diameter is 52 mm.

In order to deal with different widths of paper sheet, as such a halogen heater 82A, a 930 W section and a 600 W section are provided to form two heat distributions different in the axial direction.

The fixing roller 83 is constituted such that a solid metallic core 83A made of a metal such as iron is covered with an elastic layer 83B made of silicon rubber (hardness JIS-A10) being a heat resistant solid rubber with a thickness of 7.5 mm. Here, for example, an outer diameter is 40 mm. Further, a fluorine containing rubber may be used in place of the silicone rubber.

The pressing roller 84 is constituted such that an outer periphery of a cylindrical metallic core 84A made of aluminium with a thickness of 3 mm is covered with an elastic layer 94C made of a heat-resistant silicon rubber (hardness: JIS-A20) with a thickness of 2 mm, and is further covered with a PFA tube with a thickness of 30 μm. Here, for example, an outer diameter is 50 mm.

By a biasing section (not-shown), the pressing roller 84 is adapted to make the fixing belt 81 to come in pressure contact with the fixing roller 83.

The resin layers 82C and 84C may be formed by a cover of a FIFE (polytetrafluoroethylene) tube or a coating treatment with PTFE.

As a heating section to heat the fixing belt 81, any kind of heating head may be used, for example, an induction heating type heating member employing an exciting coil may be used. The heating head does not necessarily need to be arranged in the heating roller 82 grade, and may be arranged anywhere.

The fixing device may be provided with a tension roller to press the fixing belt.

In the above structure, if the fixing roller 83 is rotated clockwise by a driving section (not-shown), the fixing belt 81 and the heating roller 82 rotate clockwise, and the pressing roller 84 rotates counterclockwise. Here, the pressing roller 84 may be driven. The heating roller 82 is heated by a halogen heater 82A, and the fixing belt 81 coming in contact with the heating roller 82 is also heated. The pressing roller 84 is biased toward the fixing roller 83 by the biasing section (not-shown) so that a nip portion N is formed between the fixing belt 81 wound around the fixing roller 83 and the pressing roller 84, and a fed recording paper sheet P is heated and pressed at the nip portion N, whereby a toner image on the recording paper sheet P is fixed.

At this time, since transparent toner containing wax so much is layered on a most outer surface of the recording paper sheet P, even if the recording paper sheet P is a thin paper sheet with weak stiffness, the recording paper sheet P surely separates from the fixing belt 81 without sticking on the fixing belt 81. Simultaneously, the glossiness of an image increases due to the transparent toner.

In one preferable example of the fixing device 8, the width of the nip portion N is 12 mm, the nip load is 1100 N, and the process speed is 300 mm/s.

Next, the following explanation will be made about the experiment conducted to confirm the separation performance at the time that a transparent toner is transferred onto a most outer surface of a recording paper sheet being a thin paper sheet and the recording paper sheet is fixed by the above fixing device 8.

In this experiment, two kinds of thin paper sheets were used as a recording paper sheet for the case where a transparent toner was not used at all, the case where the usual transparent toner was used, and the case where the wax-rich transparent toner relating to the present invention was used. The amount of wax added in the usual transparent toner was 8 mass % equal to the amount of color toner used for the image formation, and the amount of wax added in this wax-rich transparent toner was 20 mass % larger than the amount of color toner. As a thin paper sheet, a coated paper sheet (80 g/m$^2$) for electro-photography and a regular paper sheet (60 g/m$^2$) were used. The amount of each of the usual transparent toner and the wax-rich transparent toner used to form a single layer on a recording paper sheet was 2.0 g/m$^2$. As a fixing device, the fixing device structured as shown in FIG. 2 was used.

The results of this experiment are shown in Table 1.

TABLE 1

| | Coated paper sheet for electro-photography (80 g/m$^2$) | Regular paper sheet (60 g/m$^2$) |
|---|---|---|
| Transparent toner was not used | Separation resulted in failure | Separation resulted in failure |
| Usual transparent toner was used | Separation resulted in failure | Separation resulted in failure |
| Wax-rich transparent toner was used | Separation resulted in good | Separation resulted in good |

According to this experiment, even if a recording paper sheet was a thin paper sheet incapable of being usually separated, a wax-rich transparent toner transferred on a most outer surface of a recording paper sheet makes it possible to separate the recording paper sheet surely from the fixing belt.

The above-mentioned fixing device is an example, and any kind of fixing devices may be employed.

Figure 3:
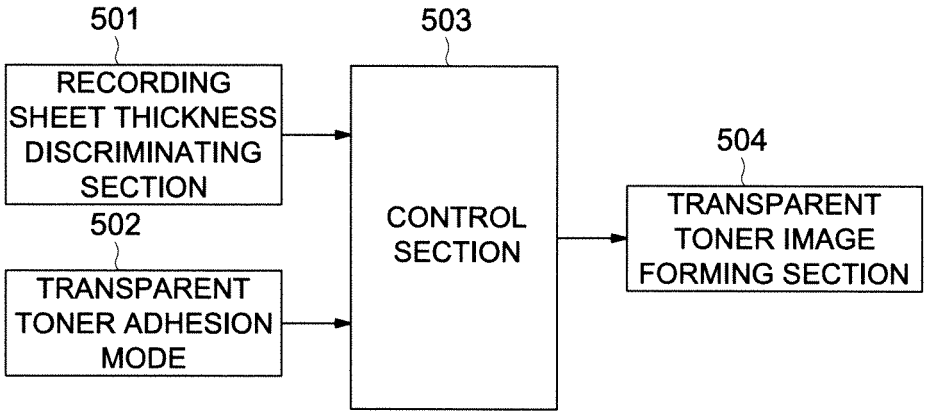
FIG. 3 is a block diagram of a principal structure relating to the present invention.

The adhesion of wax-rich transparent toner (hereafter, also referred to as a transparent toner) can also provide gloss to a recording paper sheet, and various methods are available to make a transparent toner adhere. These methods are explained based on the block diagram shown in FIG. 3.

A user selects and inputs on an operation board whether a recording paper sheet to be fed is a thin paper sheet by the use of a recording paper sheet thickness discriminating section 501. Alternately, it may be structured to provide a sensor to measure the thickness or specific gravity of a recording paper sheet at the inside of an image forming apparatus so as to automatically discriminate the thickness of a recording paper sheet.

A transparent toner adhesion mode selecting section 502 is a section with which a user selects a mode how to make a transparent toner adhere as described later.

The information from the recording paper sheet thickness discriminating section 501 and the transparent toner adhesion mode selecting section 502 is inputted into a control section 503, such as CPU, and the transparent toner image forming section 504 is operated in accordance with the inputted information. Incidentally, the transparent toner image forming section 504 corresponds to the image forming section 10T shown in FIG. 1.

Here, if the thickness of a recording paper sheet selected or discriminated by the recording paper sheet thickness discriminating section 501 is more than a predetermined thickness, it is not necessary to operate the transparent toner image forming section 504. However, even if the thickness of a recording paper sheet is more than the predetermined thickness, in the case of providing gloss, a mode selected by the transparent toner adhesion mode selecting section 502 is conducted.

Successively, a mode to make a transparent toner adhere will be explained.

(1) Mode to Make a Transparent Toner Adhere with an Equal Thickness Only on a Color Image The separation of a recording paper sheet is disturbed by a color image formed with color toner. Therefore, if transparent toner is layered only on the color image, the separation of a recording paper sheet from a fixing belt and the like becomes easy. Then, based on image signals inputted in the exposing sections 3Y, 3M, 3C, and 3K, the image forming section 10T is operated so as to make transparent toner to form a layer with an equal thickness only on portions in which color images are formed.

Figure 4:
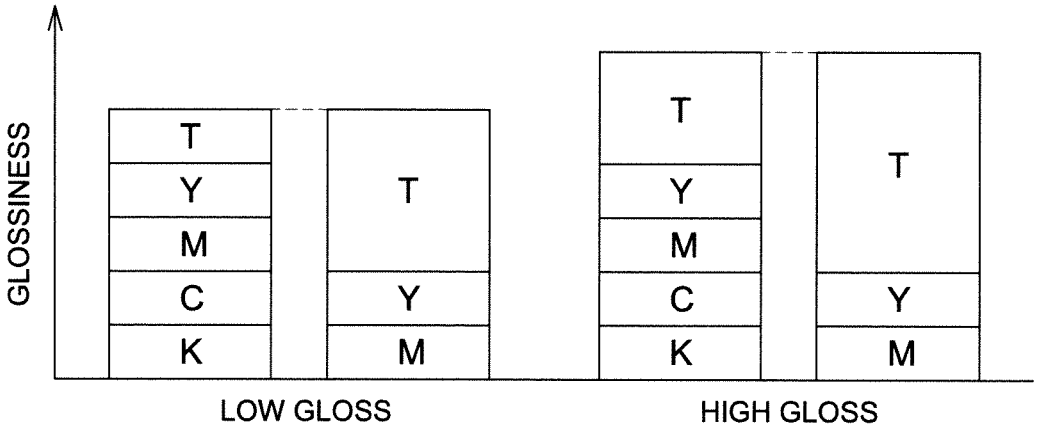
FIG. 4 is an illustration for explaining a mode to make transparent toner adhere such that the glossiness of a color image becomes even.

(2) Mode to Make a Transparent Toner to Adhere Such that the Glossiness of a Color Image Becomes Uniform The adhesion amount of a transparent toner is changed in accordance with the adhesion amount of color toners on a recording paper sheet such that the total amount of wax in both the transparent toner and the color toner is made uniform. With this, regardless of the color of a color image, the glossiness of the color image becomes uniform. Concretely, as shown in FIG. 4, a portion where a color layer is thick is developed with a small amount of a transparent toner, and a portion where a color layer is thin is developed with a large amount of a transparent toner, whereby the total amount of wax is made uniform. In FIG. 4, the symbols "T, Y, M, C, K" represent respective color toners of "transparent, yellow, magenta, cyan, and black".

Moreover, a user may be made to enable to select a low gloss image or a high gloss image on an operation board. In the case where the glossiness can be selected, the adhesion amount of a transparent toner is made to, for example, 1.6 $g/m^2$ in low gloss, 2.0 $g/m^2$ in middle gloss, and 2.4 $g/m^2$ in high gloss.

(3) Mode to Make a Transparent Toner to Adhere Such that the Total Thickness of Toner Images Becomes Uniform The adhesion amount of a transparent toner is changed in accordance with the adhesion amount of color toners on a recording paper sheet so that the thickness of toner images in which transparent toner is superimposed on color toners is made uniform. With this, fixing ability can be made uniform, so that it becomes possible to prevent image deterioration due to off-set caused in the case that an excessive amount of head is supplied to a thin thickness portion.

Figure 5:
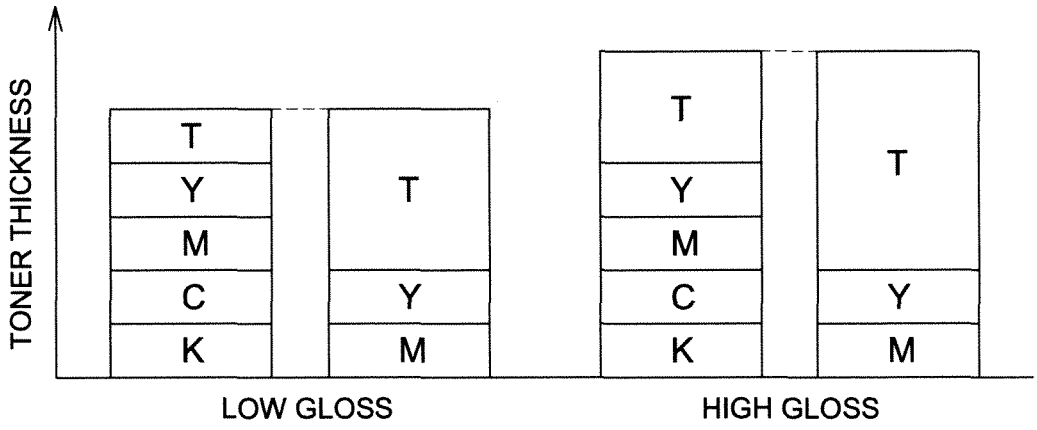
FIG. 5 is an illustration for explaining a mode to make transparent toner adhere such that a thickness of toner image becomes even all over toner images

Concretely, as shown in FIG. 5, a portion where a color layer is thick is developed with a small amount of a transparent toner, and a portion where a color layer is thin is developed with a large amount of a transparent toner, so that the total thickness of toner images becomes uniform.

At this case, the glossiness may be made also to be selectable to become low gloss or high gloss.

(4) Mode to Make a Transparent Toner Adhere Such that the Glossiness of a Character Image on a Color Image is Different from that of a Photographic Image When character images and photographic images exist together on one sheet of a recording paper sheet, it is desirable to make a character image into low gloss and to make a photographic image into high gloss. That is, the development amount of a transparent toner in character images is made small, and the development amount of a transparent toner in photographic images is increased. For this purpose, it is required to discriminate character image and photographic image. For example, images are classified into an edge region and a halftone region, and successively, an image discriminated as the edge region is made a character image and an image discriminated as the halftone region is made a photographic image. Here, the edge region is a region where a difference in density level is large and such a pattern is continued, and the halftone region is a region where a large difference in density level is not continued. The adhesion amount of a transparent toner may be changed by 1.0 $g/m^2$ between the character image and the photographic image.

(5) Mode to Make a Transparent Toner to Adhere on the Entire Surface of a Recording Paper Sheet On a recording paper sheet, a color image on which a color toner adheres has a proper gloss. However, a white background portion on which a color toner does not adhere obtain hardly gloss. For this reason, the glossiness differs partially on a recording paper sheet, so that image quality is spoiled.

In order to solve the above problems, what is needed may be to develop and transfer a transparent toner onto all over a recording paper sheet. Concretely, the control section 503 detects the size of a recording paper sheet selected automatically in accordance with the size of a document selected by a user, and the entire surface corresponding to the detected size of the recording paper sheet may be developed with a transparent toner. In this case, also, a user may be made to enable to select the amount of a transparent toner on an operation board.

The transparent toner adhesion mode selecting section 502 may be made to enable to select any one of the above-mentioned modes.

Next, an example of glossiness desirable to each of the above-mentioned cases is shown in Table 2.

TABLE 2

| | Character image | Photographic image | White background portion |
|---|---|---|---|
| Transparent toner was not used | 40 | 40 | 20 |
| Whole surface was provided with gloss | 55 | 55 | 35 |
| Glossiness of printed portions was made uniform | 55 | 55 | 20 |
| Glossiness of photographic image was made high | 55 | 65 | 20 |

The measurement of glossiness is conducted based on JIS K5600.

Incidentally, the abovementioned object of the present invention may be achieved by an image forming apparatus comprising the following preferable structures.

1. In an image forming apparatus provided with an image forming section composed of a photoreceptor, a charging section to charge at least a surface of the photoreceptor, an exposing section to irradiate the photoreceptor with light so as to form an electrostatic latent image, and a developing section to develop the electrostatic latent image formed on the photoreceptor so as to form a toner image; a transfer section to transfer the toner image onto a recording material; and a fixing device to fix the toner image onto the recording material; the image forming apparatus is characterized in that the image forming section includes a plurality of color image forming sections to form a color image with a plurality of color toners each containing wax and a transparent image forming section to form a transparent image with a transparent toner containing wax, the plurality of color image forming sections and the transparent image forming section are arranged such that the transparent image is transferred so as to form a layer on an outer surface of the color image on the recording material at the time of fixing by the fixing device, and an amount of wax added in the transparent toner is larger than an amount of wax added in each of the plurality of color toners and smaller than an amount of base resin contained in the transparent toner.
2. The image forming apparatus described in the abovementioned 1 is characterized in that the image forming section further includes a discriminating section to discriminate a thickness of the recording material and wherein when the thickness of the recording material is larger than a predetermined thickness, the transparent image forming section is not operated.
3. The image forming apparatus described in the abovementioned 1 or 2 is characterized by being provided with a transparent toner adhesion mode selecting section capable of selecting any one of a mode to make transparent toner to adhere only on the color image with an equal thickness, a mode to provide transparent toner so as to make an amount of wax even all over toner images, a mode to provide transparent toner so as to make a thickness of toner image even all over toner images, a mode to make transparent toner to adhere on the color image such that a glossiness of a character image is different from that of a photographic, and a mode to make transparent toner to adhere on whole surface of the recording material.

According to the present invention, since transparent toner containing a larger amount of wax than ordinary color toner is made to form a layer on an outermost surface of a recording paper sheet, it is possible to increase a separating ability of a recording paper sheet being passing through a fixing device.

What is claimed is:

1. An image forming apparatus, comprising:

an image forming section having a photoreceptor. a charging section to charge a surface of the photoreceptor, an exposing section to irradiate the photoreceptor with light so as to form an electrostatic latent image, and a developing section to develop the electrostatic latent image formed on the photoreceptor so as to form a toner image;

a transfer section to transfer the toner image onto a recording material: and a fixing device to fix the toner image onto the recording material;

wherein the image forming section includes a plurality of color image forming sections to form a color image with a plurality of color toners each containing wax and a transparent image forming section to form a transparent image with a transparent toner containing wax, and the plurality of color image forming sections and the transparent image forming section are arranged such that the transparent image is transferred so as to form a transparent image layer on an outer surface of the color image on the recording material at a fixing time by the fixing device, wherein an amount of wax contained in the transparent toner is larger than an amount of wax contained in each color toner of the plurality of color toners and smaller than an amount of base resin contained in the transparent toner, and wherein the image forming section further includes a discriminating section to discriminate a thickness of the recording material, and wherein when the thickness of the recording material is larger than a predetermined thickness. the transparent image forming section does not form a transparent image.

2. The image forming apparatus described in claim 1, further comprising: a control section to control the transparent image forming section to make transparent toner to adhere only on the color image so as to have an equal thickness at all portions of the color image.

3. The image forming apparatus described in claim 1, further comprising: a control section to control the transparent image forming section to make transparent toner to adhere such that a total amount of wax contained at each portion of a laminated image of the color image and the transparent image becomes uniform.

4. The image forming apparatus described in claim 1, further comprising: a control section to control the transparent image forming section to make transparent toner to adhere such that a thickness at all portion of a laminated image of the color image and the transparent image becomes uniform.

5. The image forming apparatus described in claim 1, further comprising: a control section to control the transparent image forming section to make transparent toner to adhere such that a glossiness of a character image on the color image is different from that of a photographic image.

6. The image forming apparatus described in claim 1, further comprising: a control section to control the transparent image forming section to make transparent toner to adhere to a whole surface of the recording material.

7. The image forming apparatus described in claim 1, further comprising: a transparent toner adhesion mode selecting section to select any one of a mode to make transparent toner to adhere only on the color image so as to have an equal thickness at all portions of color image, a mode to make transparent toner to adhere such that a total amount of wax contained at each portion of a laminated image of the color image and the transparent image becomes uniform, a mode to make transparent toner to adhere such that a thickness of all portions of a laminated image of the color image and the transparent image becomes uniform, a mode to make transparent toner to adhere such that a glossiness of a character image on the color image is different from that of a photographic image, and a mode to make transparent toner to adhere to a whole surface of the recording material.

8. The image forming apparatus described in claim 1, wherein transparent toner contains a styrene-acrylic type copolymer resin and wax.

9. The image forming apparatus described in claim 1, wherein the transparent toner contains wax in an amount of 10 to 40% by weight.

10. An image forming system, comprising:

an image forming section having a photoreceptor. a charging section to charge a surface of the photoreceptor, an exposing section to irradiate the photoreceptor with light so as to form an electrostatic latent image, and a developing section to develop the electrostatic latent image formed on the photoreceptor so as to form a toner image;

a transfer section to transfer the toner image onto a recording material; and a fixing device to fix the toner image onto the recording material;

wherein the image forming section includes a plurality of color image forming sections to form a color image with a plurality of color toners each containing wax and a transparent image forming section to form a transparent image with a transparent toner containing wax, and the plurality of color image forming sections and the transparent image forming section are arranged such that the transparent image is transferred so as to form a transparent image layer on an outer surface of the color image on the recording material at a fixing time by the fixing device, wherein an amount of wax contained in the transparent toner is larger than an amount of wax contained in each color toner of the plurality of color toners and smaller than an amount of base resin contained in the transparent toner, and wherein the image forming section further includes a discriminating section to discriminate a thickness of the recording material, and wherein when the thickness of the recording material is larger than a predetermined thickness, the transparent image forming section does not form a transparent image.

11. The image forming system described in claim 10, further comprising: a transparent toner adhesion mode selecting section to select any one of a mode to make transparent toner to adhere only on the color image so as to haven an equal thickness at all portion of the color image, a mode to make transparent toner to adhere such that a total amount of wax contained at each portion of a laminated image of the color image and the transparent image becomes uniform, a mode to make transparent toner to adhere such that a thickness at all portion of a laminated image of the color image and the transparent image becomes uniform, a mode to make transparent toner to adhere such that a glossiness of a character image on the color image is different from that of a photographic image, and a mode to make transparent toner to adhere to a whole surface of the recording material.

12. The image forming system described in claim 10, wherein the transparent toner contains wax in an amount of 10 to 40% by weight.

* * * * *